United States Patent [19]

Templeton

[11] 4,031,643

[45] June 28, 1977

[54] SAND PICTURE FRAME

[76] Inventor: Charles P. Templeton, 104 Cleveland Road, Rossville, Ga. 30741

[22] Filed: May 14, 1976

[21] Appl. No.: 686,313

[52] U.S. Cl. ..... 40/160; 35/26; 40/152

[51] Int. Cl.[2] ..... G09F 19/00

[58] Field of Search ..... 40/160, 152, 152.1, 40/155, 64; 35/26; 156/63, 280

[56] References Cited

UNITED STATES PATENTS

| | | | |
|---|---|---|---|
| 100,962 | 3/1870 | Adams | 40/152 |
| 3,819,436 | 6/1974 | Allen | 35/26 X |

FOREIGN PATENTS OR APPLICATIONS

| | | | |
|---|---|---|---|
| 547,662 | 4/1932 | Germany | 40/152 |

OTHER PUBLICATIONS

Sears 1975 Catalog, p. 320, Miniature Greenhouse Terrarium with Decorative Sandscaping Materials.

*Primary Examiner*—John F. Pitrelli

[57] ABSTRACT

An apparatus is disclosed for creating a sand painting which enables designs to be conveniently formed in close proximity to the sand and allows the re-use of the apparatus when it is desired to change the design. The apparatus is comprised of a 3 piece fixed frame in which is permanently secured a front transparent plate and a first backing plate having a vertical dimension approximately one-half the magnitude of the vertical dimension of the transparent plate. The transparent plate, first backing means, and frame form a lower portion of a cavity which is accessible from the top edge of the first backing plate for the introduction of sand, thereby enabling designs to be conveniently formed in the sand in the lower portion of the cavity from the relatively close proximity of the top edge of the first backing plate. To enable the re-use of the apparatus, a second backing plate is slidably engaged with the frame, with a lower edge supported by the first backing plate. An additional top member of the frame is slidably engaged with the second backing plate and the top of the transparent plate to enable disassembly of the frame permitting the emptying of the contents of the cavity and the construction of a new sand design.

8 Claims, 5 Drawing Figures

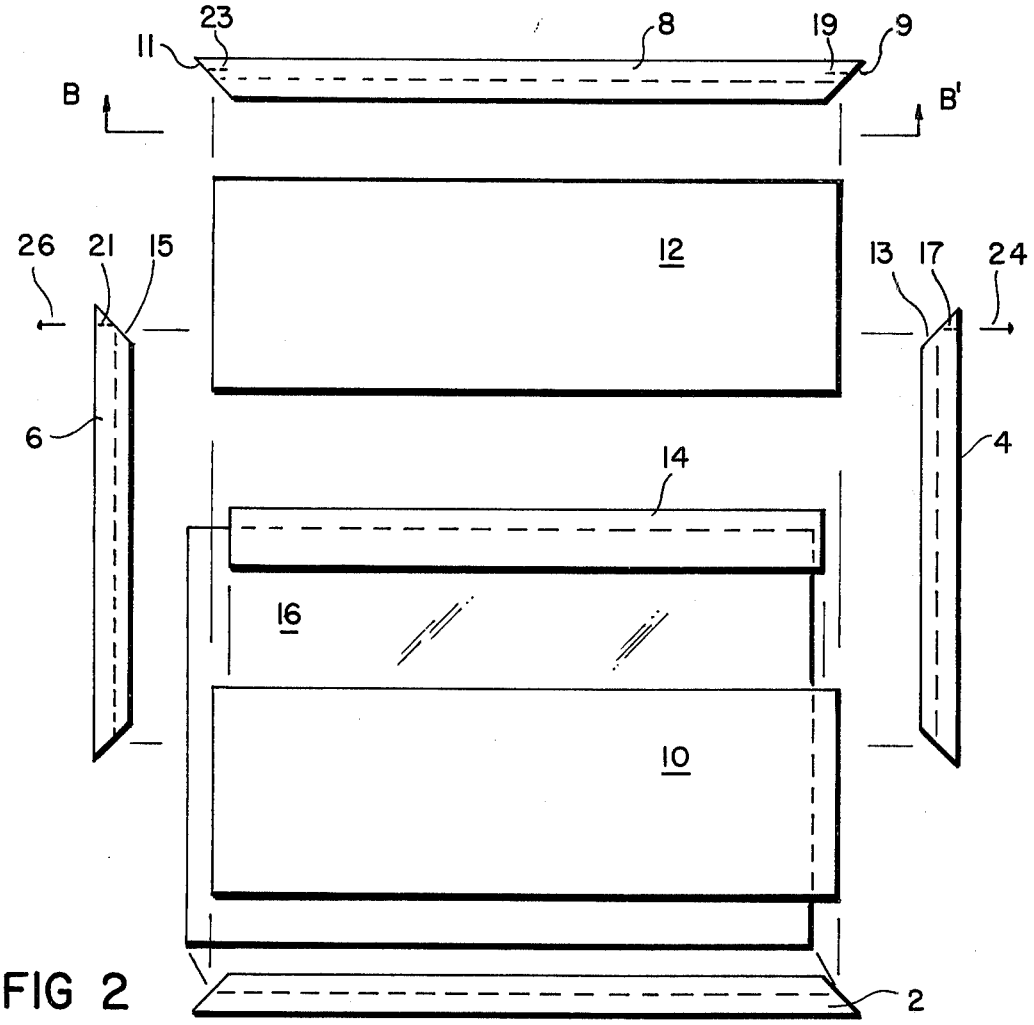
FIG 2
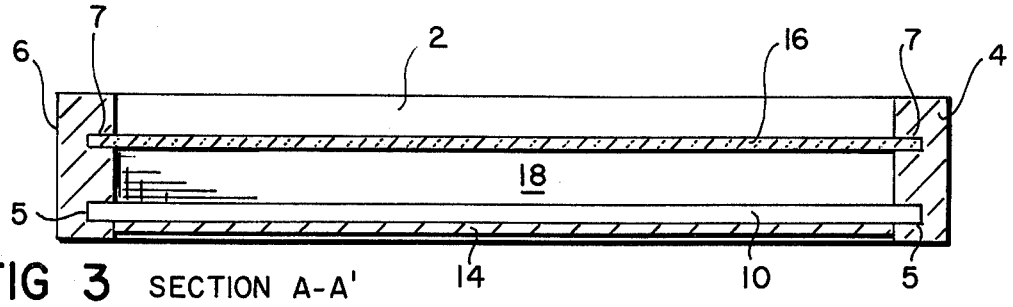
FIG 3 SECTION A-A'
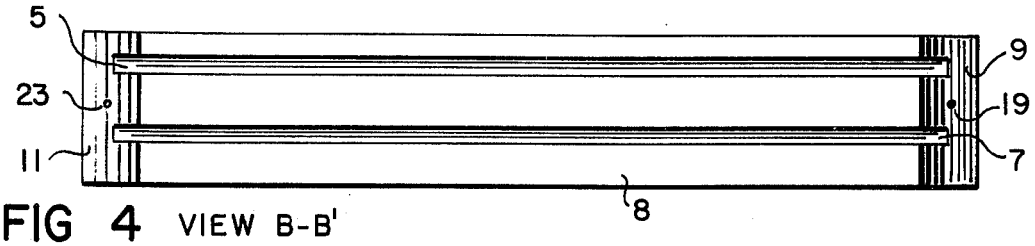
FIG 4 VIEW B-B'

SAND PICTURE FRAME

FIELD OF THE INVENTION

The invention disclosed herein generally relates to a picture device and more particularly is directed to a device in which small solid particulate materials having a plurality of color or texture characteristics are utilized to provide various desired pictorial displays.

BACKGROUND OF THE INVENTION

Sand painting by hand is an ancient art form originally practiced in the open air, by distributing colored sands in desired patterns on the ground. Recent years have seen innovations in this ancient art form, by enclosing the sand painting medium within transparent walls of a framed box-like display, enabling the vertical orientation of the picture for a free standing display or for mounting on a wall. One such technique requires that portions of the backing surface be coated with an adhesive so that colored particles which are sprinkled on the wet adhesive will be bonded in place when the adhesive dries. One drawback of this form of sand painting apparatus is that once the particles are placed in position they cannot be removed or changed and the sand composing the sand painting cannot be removed to enable the re-use of the apparatus for a different design. Another sand painting apparatus disclosed in the prior art employs sands composed of a variety of particles sized within a permanently sealed cavity, the designs within the sand being rendered by shaking or otherwise introducing relative motion between the various sized particles. One drawback of this prior art apparatus is that little control can be exercised over the configuration of the sand design and another drawback is that the sand cannot be removed from the apparatus so that a new design can be made. Still a third type of prior apparatus employs a box-like frame having transparent walls and an open top forming a cavity into which is poured the sand to form a design. The back side of one of the walls in the cavity is coated with an adhesive which is activated by a solvent after the design has acquired its desired configuration. Each of the walls bounding the cavity is of equal height. One drawback of this third prior art apparatus is that after the adhesive has been activated, the sand cannot be removed to enable the reuse of the apparatus. And a second and more serious drawback of this third prior art apparatus is that the operation of distributing the sand within the cavity is made difficult by the relatively long distance between the surface of the sand design being formed in the lower portion of the cavity and the opening to the cavity due to the relatively high walls which bound the cavity.

OBJECTS OF THE INVENTION

It is therefor an object of the invention to make sand pictures in an improved manner.

It is still another object of the invention to make sand pictures in an apparatus which can be re-used.

It is still a further object of the invention to make sand pictures in an apparatus which permits a relatively close proximity between the interface of the sand design being formed and the opening of the cavity through which the sand is introduced.

SUMMARY OF THE INVENTION

These and other objects, features, and advantages of the invention are accomplished by the sand picture frame apparatus disclosed herein. The sand picture frame apparatus comprises a frame having a horizontally disposed bottom member and two vertically disposed side members connected to the bottom member at opposite ends thereof. The side members each have a first vertical groove. A first backing plate is mounted in the first groove of the side members, having a vertical dimension of approximately one-half the magnitude of the vertical dimension of the side members. A transparent plate is mounted in a second vertical groove in each of the side members, forward of the first vertical groove, forming a lower portion of a cavity with the frame and the first backing plate. This lower portion of the cavity is accessible from the top edge of the first backing plate for the introduction of sand therein. In this manner, the designs may be conveniently formed in the sand in the lower portion of the cavity from the relatively close proximity of the top edge of the first backing plate.

A second backing plate slidably engages the first groove of the side members with a lower edge supported by the top edge of the first backing plate, having a vertical dimension of approximately one-half that of the side members. The second backing plate forms an upper portion of the cavity which is accessible from the top edge of the second backing plate for the introduction of sand therein. The frame further comprises a horizontally disposed top member having opposite ends connected to the top ends of the vertical side members, and slidably engages the top edge of the second backing plate and the top edge of the transparent plate so that the cavity may be unsealed by disassembling the top member and the second backing plate to permit the removal of an existing sand design and the reuse of the apparatus.

DESCRIPTION OF THE FIGURES

These and other objects, features and advantages of the invention will more particularly be described with reference to the drawings.

FIG. 2 is an exploded view diagram of the respective parts of the sand picture frame invention.

FIG. 3 is a cross-sectional view along the section A—A′ of the side member of the frame in FIG. 1.

FIG. 4 is an upward view of the top member of the frame.

Figure 1:
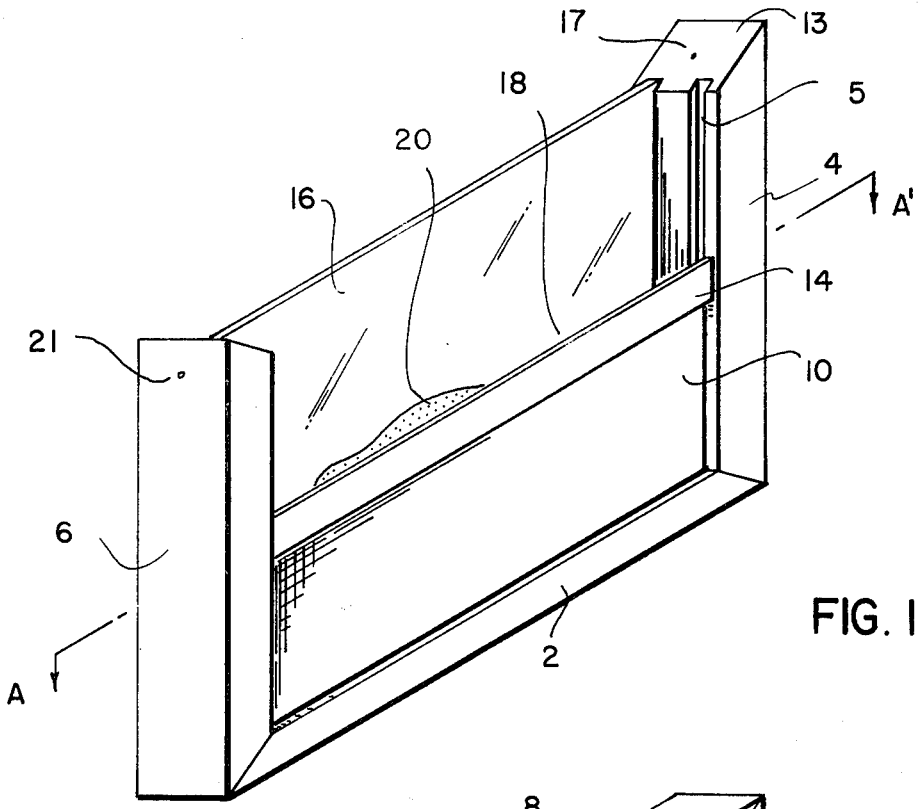
FIG. 1 illustrates the sand picture frame invention with the top member of the frame and the second backing plate removed.
Figure 5:
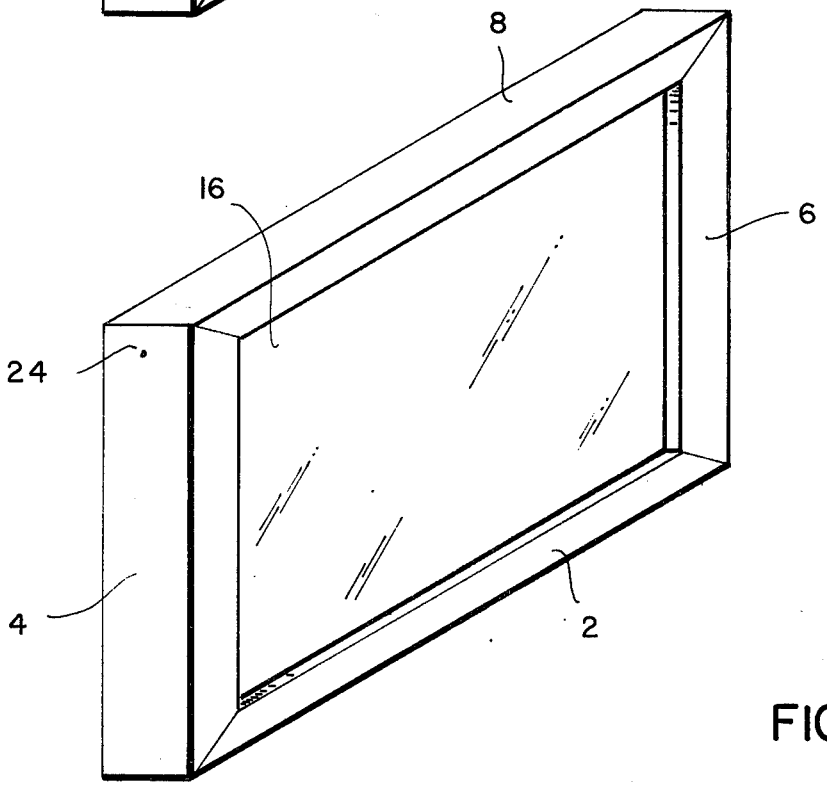
FIG. 5 is a view of the fully assembled sand picture frame invention.

DISCUSSION OF THE PREFERRED EMBODIMENT:

The sand picture frame invention is shown with a sand picture half finished in the illustration of FIG. 1. The apparatus comprises a frame which is comprised of a horizontally disposed bottom member 2 and two vertically disposed side members 4 and 6 which are connected to the bottom member 2 at opposite ends thereof. The side members 4 and 6 have a first vertical groove 5. A first backing plate 10 is permanently mounted in the first grooves 5 of the side members 4 and 6 and the bottom member 2. The first backing plate 10 has a vertical dimension of approximately onehalf the magnitude of the vertical dimension of the side members 4 and 6. A transparent plate 16 having a vertical height approximately the same as that of the side members 4 and 6, is permanently mounted in a second vertical groove 7 in each of the side members 4 and 6 and in the bottom member 2, forward of the first vertical grooves 5. The transparent plate 16 forms a lower portion of a cavity 18 with the frame and the first backing plate 10. The cavity 18 is accessible from the top edge of the first backing plate 10 for the introduction of sand 20 therein. In this manner, designs may be conveniently formed in the sand 20 in the lower portion of the cavity 18 from the relatively close proximity of the top edge of the first backing plate 10 to the surface of the sand 20 where the design is being formed.

The transparent plate 16 may be composed of a material selected from the group consisting of glass and clear plastic. The frame members 2, 4, 6 and 8 may be composed of a material selected from the group consisting of wood, plastic and aluminum. The backing plate 10 may be composed of a material selected from the group consisting of wood, pressed wood, plastic or aluminum.

A felt based pen may be employed to draw a design on the front of the transparent plate 16 before commencing the introduction of the sands 20 into the cavity 18. Different colors and textures of sand may be poured into the cavity 18. A sharp wooden or plastic stylus 22 may be employed to shape the design. The pouring of the sand and the shaping operation is greatly facilitated by the close proximity of the upper edge of the first backing plate 10 to the surface of the sand 20.

A second backing plate 12 slidably engages the first grooves 5 of side members 4 and 6. A lower edge of the second backing plate 12 is supported by the top edge of the first backing plate 10. The second backing plate 12 has a vertical dimension of approximately one-half that of the side members 4 and 6. The second backing plate 12, in conjunction with the frame and the transparent plate 16, forms an upper portion of the cavity 18 which is accessible from the top edge of the second backing plate 12 for the introduction of sand 20 therein, during later stages in the design of the sand painting, after the lower portion of the cavity 18 has been filled forming the first portion of the sand design.

A backing strip 14 may be mounted to the first backing plate 10 and overlap the top edge of the first backing plate 10 so as to prevent leakage of the sand 20 from between the first and second backing plates 10 and 12, respectively.

A horizontally disposed frame member 8 has opposite ends 9 and 11 connected to the top ends 13 and 15 of the vertical side members 4 and 6, respectively. The top member 8 slidably engages the top edge of the second backing plate 12 and the top edge of the transparent plate 16, for sealing the sand 20 within the cavity 18. The top end 13 and 15 of each of the side members 4 and 6 has a substantially 45 degree bevel with respect to the vertical direction. The top member 8 has a first horizontal groove 5 on the bottom side thereof for slidably engaging the top edge of the second backing plate 12, and a second horizontal groove 7 on the bottom side thereof which is forward and of the first horizontal groove 5, for slidably engaging the top edge of the transparent plate 16. Each end 9 and 11 of the top member 8 has a substantially 45° bevel with respect to the vertical direction, for mating with the beveled ends 13 and 15 of the side members 4 and 6, respectively. In this manner, the cavity 18 may be unsealed by disassembling the top member 8 and the second backing plate 12 to permit the re-use of the apparatus for a new sand design.

The beveled ends 13 and 15 of the side members 4 and 6 and the beveled ends 9 and 11 of the top member 8 have mating holes 17, 19 and 21, 23, respectively therethrough. A first securing pin 24 and a second securing pin 26 slidably engage the mating holes 17, 19 and 21, 23 in the side members 4 and 6 and in the top member 8, for temporarily sealing the cavity 18.

The resulting sand picture frame apparatus has the distinct advantage of being more easily operated than prior sand painting apparatus and furthermore it may be re-used.

Since the foregoing description and drawings are merely illustrative, the scope of protection of the invention has been more broadly stated in the following claims and these should be liberally interpreted so as to obtain the benefit of all equivalents to which the invention is fairly entitled.

I claim:

1. An Apparatus for creating a sand painting, comprising:

a frame comprised of a horizontally disposed bottom member and two vertically disposed side members connected to said bottom member at opposite ends thereof, said side members each having a first vertical groove;

a first backing plate which is mounted in said first grooves of said side members, having a vertical dimension of approximately one half the magnitude of the vertical dimension of said side members;

a transparent plate which is mounted in a second vertical groove in each of said side members, forward of said first vertical grooves, forming a lower portion of a cavity with said frame and said first backing plate, which is accessible from the top edge of said first backing plate for the introduction of sand therein, a second backing plate which slidably engages said first grooves of said side members with a lower edge supported by said top edge of said first backing plate, having a vertical dimension of approximately one half that of said side members, for forming an upper portion of said cavity which is accessible from the top edge of said second backing plate for the introduction of said therein;

a horizontally disposed top member having opposite ends connected to the top ends of said vertical side members, and slidably engaging the top edge of said second backing plate and the top edge of said transparent plate, for sealing said sand within said cavity.

whereby designs may be conveniently formed by said sand in said lower portion of said cavity from the relatively close proximity of said top edge of said first backing plate.

2. The apparatus of claim 1, which further comprises:

a backing strip mounted to said first backing plate and overlapping said top edge of said first backing plate, for preventing leakage of said sand between said first and second backing plates.

3. The apparatus of claim 1, wherein said frame further comprises:

said top end of each of said side members having a substantially 45° bevel with respect to the vertical direction;

said top member having a first horizontal groove on the bottom side thereof for slidably engaging the top edge of said second backing plate and a second horizontal groove on the bottom side thereof and forward of said first horizontal groove for slidably engaging the top edge of said transparent plate, each end of said top member having a substantially 45° bevel with respect to the vertical direction, for mating with said beveled ends of said side members;

whereby said cavity may be unsealed by disassembling said top member, and second backing plate to permit the construction of a new sand design.

4. The apparatus of claim 3, wherein said frame further comprises:

said beveled ends of said side members and said top member having mating holes respectively therethrough;

first and second securing pins slidably engaging said mating holes in said side members and top member, for temporarily sealing said cavity.

5. The apparatus of claim 4, which further comprises:

a backing strip mounted to said first backing plate and overlapping said top edge of said first backing plate, for preventing leakage of said sand between said first and second backing plates.

6. The apparatus of claim 1, wherein said transparent plate is composed of a material selected from the group consisting of glass and clear plastic.

7. The apparatus of claim 1, wherein said frame is composed of a material selected from the group consisting of wood, plastic and aluminum.

8. The apparatus of claim 1, wherein said backing plate is composed of a material selected from the group consisting of wood, pressed wood, plastic and aluminum.

* * * * *